US005249358A

United States Patent [19]

Tousignant et al.

[11] Patent Number: 5,249,358

[45] Date of Patent: Oct. 5, 1993

[54] JET IMPINGMENT PLATE AND METHOD OF MAKING

[75] Inventors: Lew A. Tousignant, St. Paul, Minn.; Timothy L. Hoopman, River Falls, Wis.; Kenneth C. Thompson, Stillwater, Minn.

[73] Assignee: Minnesota Mining and Manufacturing Company, St. Paul, Minn.

[21] Appl. No.: 875,129

[22] Filed: Apr. 28, 1992

[51] Int. Cl.[5] ..... C25D 1/08

[52] U.S. Cl. ..... 29/890.03; 264/317; 205/75; 165/908

[58] Field of Search ..... 205/67, 73, 75; 264/221, 317, DIG. 44; 425/DIG. 12; 29/890.03

[56] References Cited

U.S. PATENT DOCUMENTS

| | | | |
|---|---|---|---|
| 2,137,806 | 11/1938 | Paige | 205/73 |
| 2,365,670 | 12/1944 | Wallace | 204/9 |
| 2,365,690 | 12/1944 | Fassin | 242/71 |
| 2,540,805 | 2/1951 | Beebe | 205/73 X |
| 2,898,273 | 8/1959 | Forge, Jr. et al. | 204/9 |
| 3,021,241 | 2/1962 | Schneiderman et al. | 264/317 X |
| 3,109,485 | 11/1963 | Fortier | 165/1 |
| 3,277,957 | 10/1966 | New et al. | 165/80 |
| 3,329,588 | 7/1967 | Mears | 204/9 |
| 3,332,858 | 7/1967 | Bittinger | 204/11 |
| 3,445,348 | 5/1969 | Aske | 204/9 |
| 3,669,849 | 6/1972 | Schmidt | 205/75 X |
| 3,843,910 | 10/1974 | Ringuet | 317/100 |
| 3,980,747 | 9/1976 | Nakagawa et al. | 264/221 |
| 4,133,369 | 1/1979 | Maire et al. | 164/46 |
| 4,285,779 | 8/1981 | Shiga et al. | 204/9 |
| 4,295,282 | 10/1981 | Fox | 34/27 |

(List continued on next page.)

FOREIGN PATENT DOCUMENTS

0124428A1 7/1984 European Pat. Off. .

OTHER PUBLICATIONS

Appl. Phys. Lett. 53 (12), 19 Sep. 1988, American Institute of Physics, Mundinger et al. "Demonstration of high-performance silicon microchannel heat exchanger for laser diode array cooling".

(List continued on next page.)

*Primary Examiner*—Allen J. Flanigan

*Attorney, Agent, or Firm*—Gary L. Griswold; Walter N. Kirn; Mark W. Binder

[57] ABSTRACT

A unitary jet impingement plate is formed including a body portion thereof and at least one manifold integrally connected with the body portion, each having internal passages in fluidic communication with one another. At least one jet impingement orifice is provided through a plate of the body portion of the jet impingement plate through which heat transfer fluid can be directed into a fluid jet of such heat transfer fluid from the jet impingement plate and for impinging on a component or object to the thermally effected thereby. The heat transfer fluid may be heated or cooled as required depending on the specific application. Preferably, the jet impingement plate is structurally enhanced by the provision of integral posts provided in a pattern within the body portion of the jet impingement plate. More preferably, a plurality of jet impingement orifices are provided in accordance with a predetermined pattern designed for a particular application. Such a unitary jet impingement plate including integral posts is advantageously made by using a sacrificial core designed to provide the body portion and manifold of the jet impingement plate, and depositing forming material about the sacrificial core. After deposition, at least one access opening is needed through which the sacrificial core can be removed by melting, dissolving or decomposing. The at least one jet impingement orifice or plurality thereof can be provided while the sacrificial core is within the jet impingement plate, after the sacrificial core is removed, or during the deposition step.

23 Claims, 3 Drawing Sheets

U.S. PATENT DOCUMENTS

| | | | |
|---|---|---|---|
| 4,312,687 | 1/1982 | Sigworth, Jr. | 156/245 |
| 4,378,626 | 4/1983 | Eitel | 29/527.2 |
| 4,399,484 | 8/1983 | Mayer | 361/382 |
| 4,401,520 | 8/1983 | Steppan et al. | 205/75 |
| 4,421,153 | 12/1983 | Wilkinson et al. | 164/35 |
| 4,434,835 | 3/1984 | Willgoose | 164/34 |
| 4,450,472 | 5/1984 | Tuckerman et al. | 357/82 |
| 4,480,393 | 11/1984 | Flink et al. | 34/27 |
| 4,535,518 | 8/1985 | Jaqua | 29/424 X |
| 4,539,816 | 9/1985 | Fox | 62/87 |
| 4,541,171 | 9/1985 | Buckley | 29/605 |
| 4,567,505 | 1/1986 | Pease et al. | 357/81 |
| 4,569,391 | 2/1986 | Hulzwitt et al. | 165/166 |
| 4,573,067 | 2/1986 | Tuckerman et al. | 357/82 |
| 4,574,451 | 3/1986 | Smashey et al. | 29/423 |
| 4,637,456 | 1/1987 | Niggemann | 165/104 |
| 4,712,158 | 12/1987 | Kikuchi et al. | 361/385 |
| 4,741,385 | 5/1988 | Bergles et al. | 165/1 |
| 4,865,112 | 9/1989 | Schwarb et al. | 164/34 |
| 4,871,623 | 10/1989 | Hoopman et al. | 428/586 |
| 4,880,055 | 11/1989 | Niggemann et al. | 165/167 |
| 4,975,225 | 12/1990 | Vivaldi et al. | 264/28 |
| 5,038,847 | 8/1991 | Donahue et al. | 164/112 |
| 5,070,606 | 12/1991 | Hoopman et al. | 29/890.03 |
| 5,083,373 | 1/1992 | Hamburgen | 29/890.03 |
| 5,095,973 | 3/1992 | Toy | 165/185 |

OTHER PUBLICATIONS

"Electroforming A Nickel Structural Shell For A 40,000 Pound Thrust Calorimeter Test Chamber" Glenn Malone, Electroformed Nickel, Inc., pp. 1–11.

"Tiny Turbine Blades Etched From Silicon", New Trends *Machine Design* Jul. 7, 1988.

"Fabricating Closed Channel by Electroforming", H. R. Johnson et al., Plating and Surface Fining, May 1975, pp. 460–461.

"Narrow Channel Forced Air Heat Sink", IEEE Transactions on Components, Hybrids, And Manufacturing Technology, vol. CHMT-7, No. 1, Mar. 1984, pp. 154–159.

"High-Performance Heat Sinking for VLSI", IEEE Electron Device Letters, vol. EDL-2, No. 5, May 1981, pp. 126–129.

"Direct Immersion Cooling Techniques for High Density Electronic Packages and Systems", R. E. Simons et al., IBM Corporation, pp. 314–321.

"Soluble Cores: A New Way to Produce Intricate Parts", Mold & Die Corner, PM & E Oct. 1990, pp. 45–45.

Fig. 1
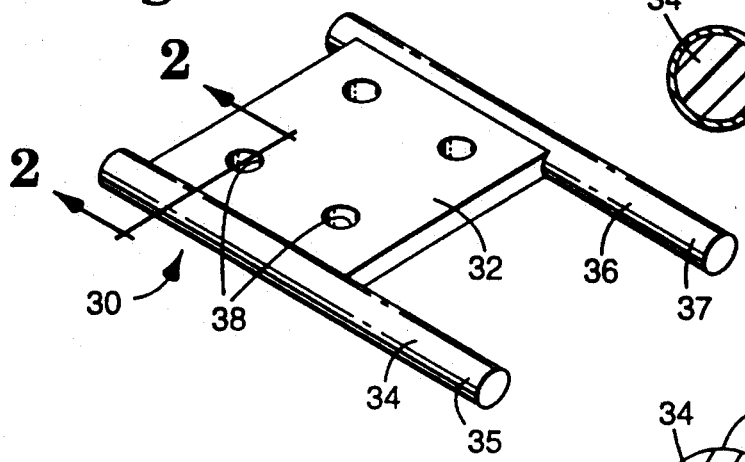
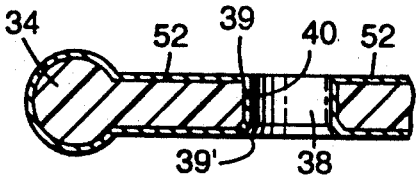
Fig. 2
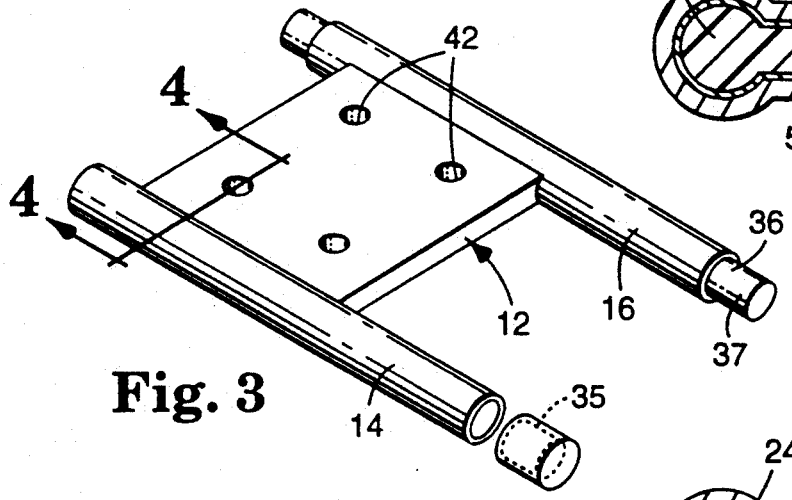
Fig. 3
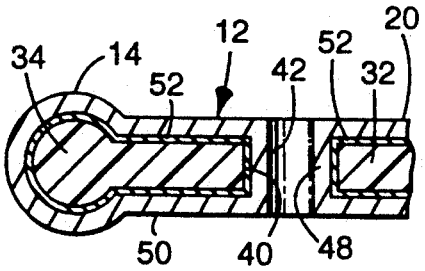
Fig. 4
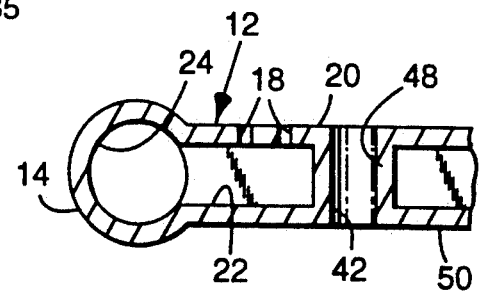
Fig. 6
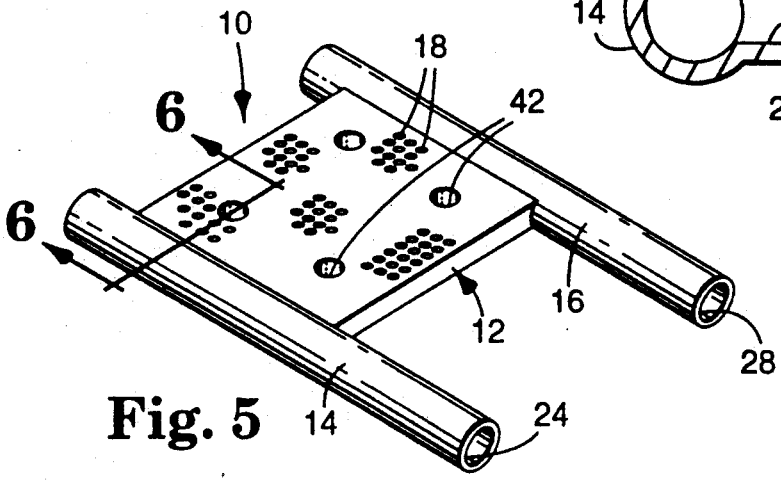
Fig. 5

JET IMPINGMENT PLATE AND METHOD OF MAKING

TECHNICAL FIELD

The present invention relates to heat transfer systems, and more particularly to heat transfer systems including a heat transfer body having jet orifices through which heat transfer fluid can be directed to impinge on a component to be thermally affected.

BACKGROUND OF THE INVENTION

With the development of electronic circuit technologies, particularly microelectronic circuits, which are faster and have denser circuits, there is a continually increasing demand for cooling techniques which can dissipate the continually increasing concentrations of heat produced at the circuit level by integrated circuit chips, microelectronic packages, other components and hybrids thereof. Moreover, such microelectronic circuit technologies require greatly improved heat removal from extremely small circuit components. This situation is worsened when an array of such chips are packed closely to one another. Thus, the density of the chips proportionally increases the heat which must be dissipated effectively by a cooling technique.

In addition to the heat transfer demands on heat exchangers, it is often required that a heat exchanger be designed for a specialized component or use environment, which may involve complex geometries. Such specialized components and environments require specialized heat exchangers.

Cooling techniques have been improved over the recent years in both air cooling applications as well as liquid cooling applications. In either case, it is known to use either cooled forced air or cooled liquid to reduce the temperature of a heat sink positioned adjacent to the circuit device to be cooled. In another known technique, the circuit chips or packages are cooled by direct immersion cooling, which is the act of directly bringing the chips or packages into contact with the cooling liquid. Thus, no physical walls separate the coolant from the chips. These liquid cooling techniques, either of the heat sink type or direct immersion cooling type, are generally believed to be required in the above described situations with dense very large-scale integration (VLSI) circuits.

One known heat exchanger suitable for use in such an environment is described in U.S. Pat. No. 4,871,623 to Hoopman et al., issued Oct. 3, 1989, which is commonly owned by the assignee of the present invention. The heat exchanger and method described in the Hoopman et al. patent provides a plurality of elongated enclosed electroformed channels that extend through a sheet member between opposing major surfaces. The sheet with the enclosed microchannels is made from a mandrel or master having a plurality of elongated ridges, wherein material is electrodeposited onto the surfaces of the mandrel with the material being deposited on the edges of the ridge portions at a faster rate than on the surfaces defining inner surfaces of the grooves until the material bridges across between the ridge portions to envelope central portions of the grooves and to form the sheet member. Such sheet member includes a base layer with a plurality of elongated projections, each of which extends from the base layer into the grooves of the mandrel, with each of the projections containing an elongated enclosed microchannel. It is also disclosed to then separate the sheet from the mandrel and additionally to use the defined sheet member with its base layer and elongated projections as the mandrel onto which electrodepositing of material again takes place in a similar manner as above thus defining additional elongated enclosed microchannels between the projections of the first formed sheet. The result is a sheet member comprising a microchannel body with a plurality of elongated enclosed channels extending therethrough, wherein the microchannels can have extremely small cross-sectional areas with predetermined shapes.

Another method for producing a suitable heat exchanger comprising a sheet member with a plurality of enclosed microchannels is disclosed in U.S. Pat. No. 5,070,606 issued Dec. 10, 1991, to Hoopman et al., which is also commonly assigned to the assignee of present invention. In this case, the sheet member with the enclosed microchannels is produced by electrodepositing a conductive material about a plurality of fibers with conductive surfaces which are operatively arranged relative to one another to define the enclosed microchannels within the sheet member. Once the electrodepositing step is completed, the fibers are removed by axially pulling the fibers which causes them to experience a reduced diameter as the fibers are stretched during removal from the sheet member. The result is a heat exchanger body having extremely small discrete microchannels passing through the heat exchanger body.

Other heat exchangers having microchannels which are suitable for cooling electronic circuit components are known which are constructed of plural elements which must be joined together not only to connect a heat exchanger body to a manifold, but also to make up the microchanneled body itself. In one known example, a silicon wafer is fabricated into a microchanneled heat exchanger by sawing into a surface of the silicon with a diamond wafer saw to define a plurality of spaced parallel microgrooves. The silicon wafer is then attached to a substrate which together with the microgrooved wafer define the microchannels. The manifold can be made as a part of the substrate attached to the microgrooved silicon wafer. Other similar heat exchangers including microchannels formed in part by microgrooves made in a silicone wafer or the like are disclosed in U.S. Pat. Nos. 4,450,472, 4,573,067 and 4,567,505 to Tuckerman et al., Tuckerman et al. and Pease et al., respectively. The described manner of forming the microgrooves includes using etching techniques. Additional examples are disclosed in U.S. Pat. No. 4,569,391 to Hulswitt et al., U.S. Pat. No. 4,712,158 to Kikuchi et al., and European Patent application No. EP 0 124 428. Each of these heat exchangers comprise multiple components fabricated into heat exchangers, wherein the plural components are provided in a manner to define the microchannels themselves as well as to make the manifolds.

The present invention specifically relates to the making of a channeled structure by depositing, and more specifically electrochemically depositing, forming material about a sacrificial core, after which the sacrificial core is removed leaving a channeled structure. The general use of sacrificial cores combined with electrochemical deposition is well known. In particular, it is known to electroplate conductive material about sacrificial cores that are inherently conductive as well as sacrificial cores which are rendered conductive by the application of a conductive coating to a non-conductive sacrificial core. Known conductive materials suitable for use as a sacrificial core include those having a low melting point and which are commonly known as fusible metals or alloys. Non-conductive sacrificial cores can be made of various waxes or the like which can be coated with a conductive substance such as silver.

U.S. Pat. No. 4,285,779 to Shiga et al. discloses a fluid circuit device having a base member with a thin sheet integrally electrocast onto the base member, wherein the fluid channels are provided by using a sacrificial core technique. Specifically, strips of soluble substance, such as a low temperature fusing alloy or wax, are applied onto a surface of the base plate. Then, the base plate as well as the strips of soluble material are electroplated. Lastly, the soluble substance is removed leaving an integral channeled circuit device. The fluid circuit device, however, is fabricated as a control device through which fluid signals can be transmitted by way of openings provided through the base member and into the various formed channels, and is not at all concerned with fabricating a heat exchanger and the manifolding of a microchanneled structure. Moreover, the fluid circuit device relies on the base member with precisely located openings as a necessary component of the fluid circuit device.

Other examples of channeled structures made by the electrochemical deposition of conductive material about sacrificial cores which are removed after the electrodeposition step are disclosed in U.S. Pat. No. 2,365,690 to Wallace; U.S. Pat. No. 2,898,273 to La Forge, Jr. et al.; and U.S. Pat. No. 3,445,348 to Aske. These patents are generally related to structures having cavities formed and opened using a sacrificial core technique and are not at all concerned with a heat exchanger connectable to a fluid circuit by a manifold.

A manner for providing orifice openings in an article formed by electrochemical deposition is disclosed in U.S. Pat. No. 3,332,858 to Bittinger. In this case, a removable core is formed out of a silicon material with projections extending from a flat surface thereof which are to be electroplated and by which orifices are to be formed. The surface including the projections is electroplated with conductive material to form the final article which is a spinneret. By plating over the projections, the electroplated material defines protuberances on the outer face of the article which can then be ground away from the article leaving orifices through that face of the spinneret. The core, however, must be wholly removed; so it is necessary that a complete side of the formed article be left open.

SUMMARY OF THE PRESENT INVENTION

The present invention overcomes the deficiencies and shortcomings associated with the prior art in that a heat transfer device with unitary components is provided including an integrally formed manifold and a body portion, wherein the body portion includes jet impingement orifices for directing heat transfer fluid against a component to be thermally affected. Additionally, the present invention is directed to a method of making such a unitary heat transfer device with jet impingement orifices. Preferably, the heat transfer device body portion is structurally reinforced by posts for increasing the structural integrity of the body and minimizing plate deflection of the body. In situations such as described in the Background section of this application wherein heat exchangers are used to cool dense VLSI circuits, it is critical to minimize plate deflection to insure sufficient cooling without harming any of the components. With such dense circuits, the space available for the heat exchangers is very limited, but such heat exchangers must have high heat exchange capabilities.

In general, microchanneled heat exchangers are well suited to situations where relatively great heat dissipation is required, particularly with small components such as electronic chips, packages and other components. The ability to meet the cooling demands of such components advantageously increases output and life expectancy of these components. Moreover, smaller heat exchangers drastically reduce the overall size and weight of the device containing such electronic components. Such size restrictions combined with the cooling requirements have become the limiting factors in new system designs, particularly in the superconductor industry. Microchanneled heat exchangers effectively provide localized cooling specifically where needed in such electronic systems within very limited space requirements. Furthermore, and in accordance with the present invention, excellent heat transfer is provided by using fluid jets directed at a specific component or components preferably in a direction normal to such component or components. Such direct impingement of heat transfer fluid against the component greatly enhances heat transfer to the fluid because no other element is provided between the fluid and the component through which heat must be transferred. In other words, heat is directly transferred between such component and the heat transfer fluid. Moreover, and in accordance with the present invention, complex geometries of heat transfer device design with jet impingement orifices can be fabricated so as to effectively meet the cooling demands of almost any shaped component or other medium requiring a specific heat exchanger geometry. Even with such complex geometries of the heat transfer devices including jet impingement orifices, a jet impingement plate formed in accordance with the method of the present invention provides such heat transfer devices of high structural integrity that exhibit a minimum of plate deflection under fluid pressures required for effective cooling.

The above advantages are achieved by a unitary jet impingement plate for connection with a pressurized heat transfer fluid source and which is used for directing heat transfer fluid to impinge a component or components to be thermally affected by the heat transfer fluid. The term component is not meant to be limiting to any specific type of component, such as electrical, but is meant to include any object that is to be heated or cooled by impingement with heat transfer fluid. The heat transfer fluid may be heated or cooled depending on the specific application. The jet impingement plate comprises a manifold including an internal passage with an inlet thereof for connection to the heat transfer fluid source. A body portion of the jet impingement plate is integrally made with the manifold, and the body portion includes an internal passage in fluidic communication with the internal passage of the manifold. Moreover, the body portion is provided with at least one jet impingement orifice, and preferably a pattern of such jet impingement orifices, through which heat transfer fluid is directed. Fluid jets of heat transfer fluid are streamed from the jet impingement orifices of the jet impingement plate which are used to impinge a component or components to be thermally affected by the heat transfer fluid. Preferably, the internal passage of the body portion is defined between a pair of spaced plates which are integrally made with the manifold. Plural manifolds may be used similarly. Integral posts are also preferably provided connected between the pair of plates defining the internal passage of the body portion for increasing structural integrity and minimizing jet plate deflection. Such posts, like the jet impingement orifices, are preferably arranged in a predetermined pattern for maximizing structural integrity without compromising fluid flow requirements. Such posts may be closed, apertured, or a combination of both, where any such apertures may be used to allow fluid flow through such apertures, or may be used for mounting purposes of the jet impingement plate.

Also in accordance with the present invention, such a unitary jet impingement plate is made by forming a sacrificial core having a shape generally similar to the overall shape of the jet impingement plate. Thereafter, forming material is deposited about the sacrificial core by any deposition technique, but preferably by electrochemical deposition, for providing an integral body portion and manifold comprising the unitary jet impingement plate. Next, at least one access opening must be provided through the jet impingement plate, and then the sacrificial core is removed through the access opening. Removal may be conducted by melting, dissolving, or decomposing the sacrificial core. Furthermore, at least one jet impingement orifice is provided through one plate of the body portion through which heat transfer fluid can pass for producing the fluid jets of heat transfer fluid to impinge a component or components. The jet impingement orifices can be provided while the sacrificial core is within the body portion or after it has been removed. Moreover, such jet impingement orifices can be made by providing protuberances on the sacrificial core which after deposition form bumps which are ground away or otherwise removed to finish making the jet impingement orifices. Furthermore, posts, whether apertured or not, are preferably provided integrally connected between spaced plates comprising the body portion by providing holes through the body forming portion of the sacrificial core and by controlling the deposition step to produce such posts integral with the body portion of the jet impingement plate.

BRIEF DESCRIPTION OF THE DRAWINGS

The present invention will be further described below with reference to the accompanying drawings, wherein plural embodiments in accordance with the present invention are illustrated and described, in which, FIG. 1 is a perspective view of a sacrificial core including a body forming portion and first and second manifold forming portions;

FIG. 2 is a partial cross-sectional view taken along line 2—2 in FIG. 1 through a first manifold forming portion and the body forming portion of the sacrificial core;

FIG. 3 is a perspective view of a unitary heat exchanger including a heat exchanger body and first and second manifolds formed about the sacrificial core of FIG. 1 before jet impingement orifices are provided through a plate of the heat exchanger body;

FIG. 4 is a partial cross-sectional view taken along line 4—4 in FIG. 3 illustrating the first manifold and body of the heat exchanger formed about the first manifold forming portion and body forming portion of the sacrificial core;

FIG. 5 is a perspective view similar to FIG. 3 but after the sacrificial core has been removed and with a plurality of jet impingement orifices provided through a plate of the heat exchanger body;

FIG. 6 is a partial cross-sectional view taken along line 6—6 in FIG. 5 through the first manifold and heat exchanger body provided with jet impingement orifices;

DETAILED DESCRIPTION OF THE PREFERRED EMBODIMENTS

Figure 7:
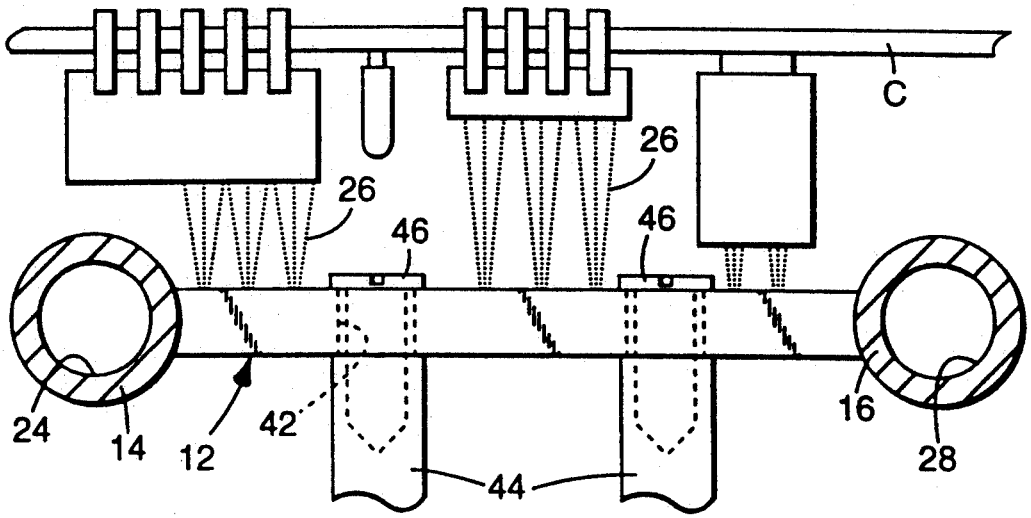
FIG. 7 is a side-view, partially in cross-section, showing a jet impingement plate formed in accordance with the present invention in use for directing jets of heat transfer fluid to impinge electronic components mounted on a circuit board, and with the jet impingement plate mounted in position relative to such electronic circuit board.

Referring now to the drawings, wherein like numerals are used to designate like components throughout the several figures, and initially to FIGS. 1–7, illustrated is a unitary jet impingement plate 10 comprising a body portion 12, a first manifold 14, and a second manifold 16. The first and second manifolds 14 and 16, respectively, are connectable to fluid sources and/or a reservoir as part of a fluid circuit through which heat transfer fluid can be circulated. Only one of the first and second manifolds 14 and 16, respectively, is needed to supply the heat transfer fluid. The jet impingement plate 10 can be used a means for directing heat transfer fluid to be used as a heat source or as a heat sink for heating or cooling a component.

The body portion 12 is integrally made with and of the same material as the first and second manifolds 14 and 16 by the method of the present invention described below. As shown in FIGS. 5 and 6, the body portion 12 of the jet impingement plate 10 is provided with a plurality of jet impingement orifices 18 provided through a first plate 20 of the body portion 12. Such jet impingement orifices 18 provide openings within the external surface of the first plate 20 connected from the internal passage 22 of the body portion 12 which is in turn connected with the internal passage 24 of the first manifold 14. Thus, heat transfer fluid supplied within the first manifold 14 travels within the internal passage 24 and into the internal passage 22 of the body portion 12 and then through the jet impingement orifices 18.

The heat transfer fluid exiting the jet impingement orifices 18 forms fluid jets 26 which are directed to impinge against one or more components, such as electronic components of an electronic circuit board C, as illustrated in FIG. 7. The pressure of the heat transfer fluid as supplied to the jet impingement plate 10 and the diameter of the jet impingement orifices 18 determine the rate of application of heat transfer fluid by the fluid jets 26 and thus in part determines the heat transfer rate thereof. Such direct impinging of a component with heat exchange fluid maximizes heat transfer between the heat transfer fluid and the component in that heat is directly transferred between the two. In other words, no element is positioned between the heat transfer fluid and the component through which heat must transferred. Thus, the present invention takes advantage of the excellent heat transfer provided by use of fluid jets. Moreover, the fluid jets are preferably directed normal to the component. Furthermore, the pattern and precise positioning of the jet impingement orifices 18 permits the fluid jets 26 to be very specifically directed in such pattern to provide very effective localized heating or cooling where needed. In one specific use in accordance with the present invention, cooling fluid may be directed against electronic components.

In one embodiment of the present invention, illustrated in FIGS. 5–7, the body portion 12 is generally planar although many other shapes are contemplated as emphasized below. In this regard, it is a specific advantage of the method of the present invention that curved or otherwise complex geometries are possible for the body portion 12.

The jet impingement plate 10, as shown in FIGS. 5–7, includes both a first manifold 14 and a second manifold 16. With the provision of two manifolds, heat transfer fluid may be supplied through both of the manifolds 14 and 16 by way of the internal passage 24 of the first manifold 14 connected with the internal passage 22 of the body portion 12 and through an internal passage 28 of the second manifold 16 which is also connected with the internal passage 22 of the body portion 12. Moreover, and as described below, the first manifold 14, second manifold 16, and the body portion 12 are advantageously integrally made to provide such fluid connection without leakage.

In order to define the passages within the body portion 12, first manifold 14 and second manifold 16, in accordance with the method of the present invention, a sacrificial core 30, as shown in FIG. 1, may be used. The external shape of the sacrificial core 30 is generally similar to the external shape of the unitary heat exchanger 10. More particularly, the sacrificial core 30 includes a body forming portion 32, a first manifold forming portion 34, and a second manifold forming portion 36. The external surfaces of the body forming portion 32, the first manifold forming portion 34 and the second manifold forming portion 36 define the interior surfaces of the internal passages 22, 24 and 28 of the body portion 12, the first manifold 14, and the second manifold 16, respectively.

The sacrificial core 30 can be formed as a single unit, or may be made up of separate elements adhered, fused or otherwise fixed together. Specifically, the sacrificial core 30 including the body forming portion 32 and manifold forming portions 34 and 36 can be formed as a unit by a molding process or can be made separately and then fixed together by melt fusing or adhesive. For example, the first and second manifold forming portions 34 and 36 can be formed together in one piece as part of a larger supporting structure (i.e., U-shaped or rectangular), and the body portion 32 can then be positioned on and joined to the first and second manifold forming portions 34 and 36 by melting and fusing the component together at such joints.

Suitable materials usable for the sacrificial core 30 include waxes, plastics and fusible metals or alloys. Specifically, examples of suitable waxes include "Machineable Wax" available from Freeman Manufacturing and Supply Company of Cleveland, Ohio and "Tuffy" injection wax available from Kerr Manufacturing Company of Romulus, Mich. An example of a suitable plastic is a polyacetal sold by E. I. Dupont De Nemours and Company of Wilmington, Del. under the trademark "DELRIN". Fusible or low melting point metals and alloys include the fusible alloys sold under the trademark "INDALLOY" sold by Indium Corporation of America of Utica, New York, particularly "INDALLOY 255" and "INDALLOY 281". It is understood that many other waxes, plastics and metals could be used provided that they can be melted, dissolved or decomposed without substantially harming the material of the jet impingement plate which is formed about the sacrificial core 30 as described below.

It is understood that any suitable wax or plastic or combinations and blends thereof could be simply formed into the entire sacrificial core 30 by a single molding step, such as by conventional injection molding techniques. Moreover, when using a fusible alloy, it is preferable to mold the fusible alloy into the sacrificial core 18 by single molding step. Alternatively, the sacrificial core 30 could be made by a machining process, wherein a block of suitable wax, plastic or fusible metal could be machined down to the desired core shape.

Referring back to FIGS. 1–4, the body forming portion 32 of the sacrificial core 30 is preferably provided with a plurality of holes 38 defined by internal surfaces 40. Such holes 38 are not necessary, but are preferably provided to form mounting apertures 42 through the body portion 12 of the jet impingement plate 10 for mounting the jet impingement plate 10 in position as desired. In this regard, FIG. 7 shows the jet impingement plate 10 mounted in position by supports 44 and screws 46, wherein the screws 46 pass through the mounting apertures 42 to hold the jet impingement plate 10 against the supports 44. Any other mounting technique using such mounting apertures 42 are contemplated. Moreover, if any other mounting technique is used that does not require the use of mounting apertures, then the mounting apertures 42 need not be provided but may be provided for structural integrity as further explained below.

The holes 38 and the internal surfaces 40 can be made through the body forming portion 32 by drilling or any other machining technique. Alternatively, the holes 38 can be formed during the formation of the body forming portion 32 of the sacrificial core 30. Such may occur before or at the same time as the formation of the first and second manifold forming portions 34 and 36. In any case, to form the holes 38 during a molding step, the mold used for forming the body forming portion 32 is provided with elements having external surfaces that correspond to the internal surfaces 40 of the body forming portion 32.

After the sacrificial core 30 is fully formed, a unitary jet impingement plate 10 is formed about the sacrificial core 30. Then, the sacrificial core 30 is removed. In accordance with the present invention, the unitary jet impingement plate 10 is formed by a deposition step. Deposition is defined as the controlled formation of material on an article from the ambient solution, gases or mixtures thereof within which the article is located. Deposition includes electrochemical, chemical and physical techniques and the like. Chemical deposition means techniques for depositing body forming material as a result of a chemical reaction, such as by chemical vapor deposition (CVD). Physical techniques include deposition methods such as spraying or sputtering techniques or the like. Preferably, electrochemical plating is utilized.

Electrochemical plating is defined as the deposition of a continuous layer of material onto an article by the interaction in solution of a metal salt and supplied electrons which are the reducing agent of the metal salt. One type of electrochemical plating is known as electroless plating within which the electrons supplied for reduction of the metal salt are supplied by a chemical reducing agent present in the solution. Another type of electrochemical plating is known as electrolytic plating, or more commonly as electroplating, wherein the electrons used for reduction of the metal salt are supplied by an external source such as a battery, generator or other DC power supply including rectifiers of AC current. Furthermore, in electroplating, the object to be plated must have or be provided with a conductive surface. Furthermore, conventionally known pulse plating techniques can be optionally used where periodic reversals of the current flow direction can be controlled to enhance electroplating of certain metals, particularly with copper.

A major advantage of electroless plating is that material can be plated on properly prepared non-conductors as well as further described below. The most common metals that can be deposited by electroplating or by electroless plating are nickel, copper, gold and silver; however, many other known metals, alloys, compounds and composites are also known to be capable of deposition by electrochemical plating. The formation of a self-supporting structure by electrochemical plating, such as the unitary jet impingement plate 10 of the present invention, is hereinafter referred to as electroforming.

Referring again to FIGS. 3 and 4, the unitary jet impingement plate 10 is formed, preferably electroformed, substantially completely about the sacrificial core 30 so as to substantially envelope the sacrificial core 30 and with a shape generally similar to the shape of the sacrificial core 30. Moreover, the body portion 12 is integrally formed at the same time with the first and second manifolds 14 and 16, and of the same material. Furthermore, the forming material is also deposited on the internal surfaces 40 of the body forming portion 32 of the sacrificial core 30.

The result of such deposition of forming material on the internal surfaces 40 within the holes 38 is a plurality of apertured posts 48 that integrally connect the first plate 20 and a second plate 50 of the body portion 12. The number of posts 48 corresponds to the number of holes 38 defined by internal surfaces 40. This formation of the apertured posts 48 at the same time as the formation of the body portion 12 and first and second manifolds 14 and 16 results in an integral structure that exhibits a greatly improved strength and which can accommodate substantially higher fluid pressures than that of heat exchangers assembled from multiple parts. Furthermore, the number of and pattern of the apertured posts 48 can be chosen for specific strength characteristics in addition to their use as providing mounting apertures 42.

When electrochemical deposition is used to electroform the jet impingement plate 10, such electrochemical deposition, particularly with electroplating, may result in forming material being deposited more rapidly at sharp edges of the sacrificial core 30 than at other portions. Thus the opposed corner edges 39 of internal surfaces 40 may have a tendency to be electroplated faster than the remainder of the internal surfaces 40 depending on the rate of deposition. It has been found that slower rates of deposition reduce this tendency. Moreover, the edges 39 can be chamfered or rounded as shown in FIG. 2 at 39' to enhance the formation of uniform walls of the posts 48 and to increase post strength.

As mentioned above, the sacrificial core 30 may comprise a wax, plastic, fusible alloy or the like. If the method of deposition of forming material used to form the jet impingement plate 10 is electroplating, then it is necessary that the outer surface of the sacrificial core 30 onto which the forming material is to be deposited be conductive. In the case of using a non-conductive wax or plastic sacrificial core, it is first necessary to render the external surface thereof conductive. One manner of rendering the external surface conductive is to treat the surface to form a thin conductive layer thereon. This is conventionally done by applying a very thin layer of a conductor such as silver on the external surface of those portions of the sacrificial core 30 onto which deposition will take place. Any of the known conventional layering or coating techniques can be utilized to provide a thin conductive layer including painting, spraying or an initial use of electroless plating. Thereafter, electroplating can be conducted as if the sacrificial core 30 were totally metallic. If electroless plating is to be utilized as the manner of forming the entire jet impingement plate 10, then it may not be necessary to first render conductive the sacrificial core 30. Proper electroless plating may require certain surface preparation steps, which are well known, and which may vary depending on the metal to be deposited and the core forming material. Typical steps include, in order, treatment with an etchant, a neutralizer, a catalyst, an accelerator and then the electroless metal bath.

As shown in FIGS. 2 and 4, the sacrificial core 30 including the body forming portion 32 and first manifold forming portion 34 may be coated with a conductive layer 52 when it is necessary to render the external surfaces thereof conductive for plating by the electroplating method. In contrast, it is not necessary to provide the conductive layer 52 when electroless plating is to be used as a manner of electrochemical deposition, if the sacrificial core 30 comprises a conductive material such as a fusible alloy, or if other deposition techniques are to be used. As above, if electroless deposition is to be conducted, other surface treatments may be required.

Although it is preferable that electrochemical deposition be used to make the heat exchangers according to the present invention, it is contemplated that other deposition techniques, noted above, could be used. For example, some metals, such as nickel, are known to capable of deposition onto an article by chemical vapor deposition (CVD) methods. Moreover, other non-metals could be used and deposited by a CVD method if the material deposited is strong enough to withstand the fluid pressures and the heat of a specific heat transfer application.

After the forming material is deposited onto the sacrificial core 30 and the unitary jet impingement plate 10 is formed, the sacrificial core 30 must be removed. In order to prepare for the removal of the sacrificial core 30, some access must be provided from external of the shell forming the unitary jet impingement plate 10 to at least one of the passages 22, 24 or 28 formed within the unitary jet impingement plate 10 by the sacrificial core 30. One manner to do this, as shown in FIG. 3, is to control the deposition of forming material onto the sacrificial core 30 so that at least a portion of one end of the first or second manifold forming portions 34 or 36 of the sacrificial core 30 is not covered by the forming material. In other words, at least a portion of one of the manifold forming portions 34 or 36 remains free of forming material after the deposition step is complete and the unitary jet impingement plate 10 is fully formed. As seen in FIG. 3, an end 37 of the manifold forming portion 36 is shown free of forming material.

This can be done in a variety of ways. If the sacrificial core 30 is made of a non-conductive material such as a wax or plastic and electroplating is to be used as the deposition step, then by simply not coating a portion of the manifold forming portion 34 or 36 with a conductive layer, such portion will remain free of forming material. In the cases where the sacrificial core 30 is conductive or rendered conductive and electroplating is to be used or where electroless deposition or another chemical or physical deposition method is to be used on a conductive or non-conductive sacrificial core 30, then it may be desirable to positively treat such a portion of the manifold forming portions 34 or 36 so as to prevent deposition of forming material thereon. This can be done by wrapping or otherwise coating such a portion with a tape or coating of material that will prevent the deposition of forming material thereon. When using electroless deposition, deposition can be prevented on such a portion by coating or wrapping that portion with a material or tape comprising any one of known materials onto which electroless deposition does not easily deposit. In the case of electroplating a conductive sacrificial core 30, it is preferred to use a non-conductive tape to provide the at least one portion to which forming material will not be deposited. It is, however, contemplated that any other non-conductive coating, paint or the like could be used instead. Moreover, it is preferred that more than one access opening be provided by controlling the deposition so that a plurality of sacrificial core portions remain after deposition that are free of forming material. More preferably, it is desirable that such portions free of forming material be provided at both ends of each of the manifold forming portions 34 and 36.

Another manner of providing the needed access opening through the shell of the unitary jet impingement plate 10 is also illustrated in FIG. 3, which is used when the manifold forming portions 34 and 36 including the ends at 35 and 37 thereof, respectively, are entirely covered by forming material. The access opening can be provided by removing the forming material from at least one of or all of the ends 35 and 37. This removal can be easily done by simply cutting away a portion of the manifolds 14 or 16 (as illustrated in FIG. 3 where a portion of first manifold 14 is cut away) including the ends 35 and/or 37. Other means for providing an access anywhere along the first or second manifolds 14 and 16 such as grinding, drilling or the like are also contemplated.

No matter how the access opening or openings are provided through the shell of the unitary jet impingement plate 10, the step of removing the entire sacrificial core 30 follows. The preferred manner of removing the sacrificial core 30 is by heating the unitary jet impingement plate 10 including the sacrificial core 30 to a temperature above the melting point of the sacrificial core 30 but below the melting point of the forming material making the unitary jet impingement plate 10. Thus, when heating is to be used to melt the sacrificial core 30 the choice of materials for the sacrificial core 30 is dictated by its melting temperature as compared to that of the forming material of the unitary jet impingement plate 10. The forming material of the unitary jet impingement plate 10 is preferably nickel or copper. Waxes and plastics such as those noted above are in most cases suitable for such sacrificial core use. Known low melting temperature metals and alloys, also as noted above and known as fusible metals and alloys, also work well.

To accomplish the removing step, the combination of the unitary jet impingement plate 10 and sacrificial core 30 are preferably placed in a heated environment or heat is directly applied to the unitary jet impingement plate 10. Furthermore, the access opening is preferably provided in a position and held in that position so that the flow of molten sacrificial core material under the influence of gravity will completely drain all of the sacrificial core forming material from within the unitary jet impingement plate 10. It is also contemplated that one or more access openings could be connected to a pressurized source or a vacuum to assist in the removal of sacrificial core material.

Alternately, the sacrificial core 30 can be removed by chemically dissolving the sacrificial core 30 in a solution. In that case, the sacrificial core 30 should be comprised of a material which is easily dissolved in a solution that will not substantially harm the forming material of the unitary jet impingement plate 10. In a similar manner, the material of the sacrificial core 30 can be a material which decomposes as a result of the application of a controlling affect. For example, when the plastic material known as DELRIN, discussed above, is used in forming the sacrificial core 30, the application of heat as the controlling affect causes such material to decompose to formaldehyde which escapes as a gas.

After the deposition and core removing steps have been completed, a further step in making the jet impingement plate 10 is the forming of the jet impingement orifices 18 through at least one of or both of the first plate 20 and second plate 50. If the jet impingement plate 10 is to direct the fluid jets 26 from only one side of the jet impingement plate 10, then only one of the first and second plates 20 and 50 need be provided with jet impingement orifices 18. If the jet impingement plate 10 is to be inserted between components to be thermally affected, both the first and second plates 20 and 50 may be provided with jet impingement orifices 18. FIGS. 5 and 6 illustrate orifices 18 formed through the first plate 20.

The jet impingement orifices 18 can be formed during the deposition step, as described below, or may be made after the deposition step is complete and before or after the sacrificial core 30 is removed.

One method comprises simply drilling the jet impingement orifices 18 through one or both of the first and second plates 20 and 50. In such case, the drill bit diameter would determine the diameter of each of the jet impingement orifices 18. Moreover, the number of and pattern that the jet impingement orifices 18 are provided through the first or second plate 20 or 50 is determined depending on the specific use of the jet impingement plate 10. For example, as shown in FIG. 7, the jet impingement orifices 18 can be specifically provided to concentrate the fluid jets 26 to impinge precisely located electronic components. Thus, the pattern of jet impingement orifices 18 can be any regular pattern for generally impinging an overall component or the like the same thereover, or may be specifically arranged in accordance with a predetermined pattern of components.

Other machining techniques are also contemplated. Specifically, electron discharge machining (EDM) can be utilized. Such a machining technique can similarly be controlled to provide the jet impingement orifices 18 at a specific pattern, as discussed above. Moreover, the EDM technique provides an additional benefit in that EDM can be controlled while making the jet impingement orifices 18 to provide complex profiles for the jet impingement orifices 18. That is, the jet impingement orifices 18 need not be formed cylindrically, but may include curves within the side profile as viewed in cross-section.

Figure 8:
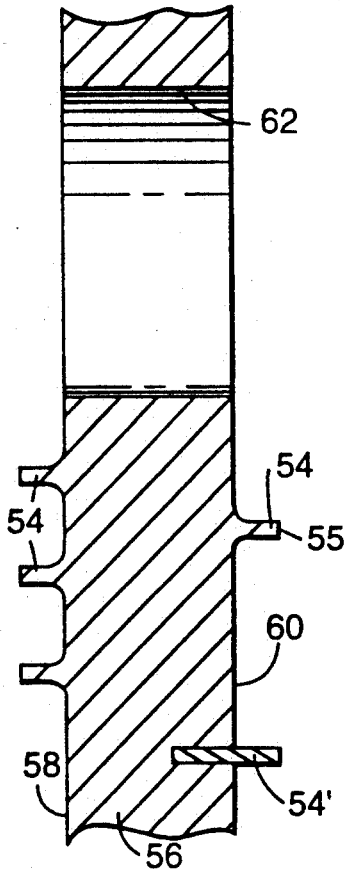
FIG. 8 is a partial cross-sectional view of another sacrificial core in accordance with the present invention having orifice forming protuberances extending from opposite surfaces thereof.
Figure 9:
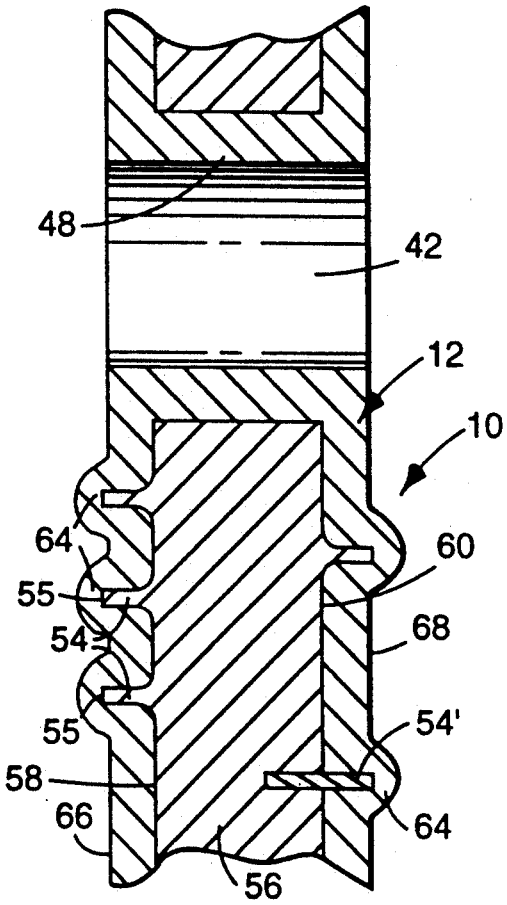
FIG. 9 is a partial cross-sectional view similar to FIG. 8 but with a heat exchanger body formed about the sacrificial core including the orifice forming protuberances thereof.
Figure 10:
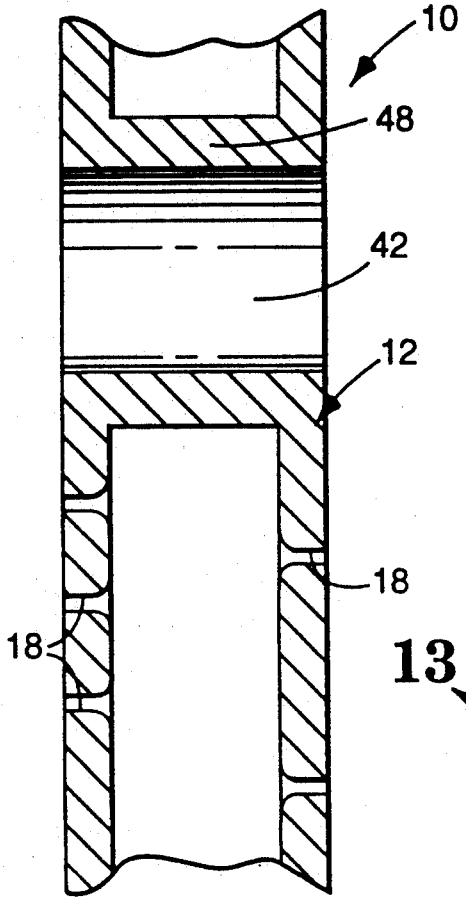
FIG. 10 is a partial cross-sectional view similar to FIG. 9 but with the sacrificial core removed and with jet impingement orifices finished by removing the bumps of body forming material from the external surfaces of the opposite plates.

Yet another method contemplated for providing the jet impingement orifices 18 which also advantageously permits control of the profile of each jet impingement orifice 18 is illustrated in FIGS. 8-10. The jet impingement orifices 18 are formed by providing protuberances 54 extending from a modified sacrificial core 56. As shown in FIG. 8, protuberances 54 are provided extending from a first surface 58 and a second surface 60 of the modified sacrificial core 56. The modified sacrificial core 56 is also preferably provided with at least one external surface 62 which defines a hole through the sacrificial core 56. The protuberances 54 are shown provided extending from the first and second surfaces 58 and 60 to define the patterns of jet impingement orifices 18. However, if heat transfer fluid is to be directed from only one side of the jet impingement plate 10, then protuberances 54 would be provided from one of the first and second surfaces 58 and 60. Moreover, the modified sacrificial core 56 can be formed by any of the methods discussed above, including molding or machining techniques. The protuberances 54 can be formed by molding them with at least the body forming portion of the modified sacrificial core 56. Alternately, the protuberances 54 can comprise separately formed elements such as shown at 54' which are inserted within the body forming portion of the modified sacrificial core 56. Such separately formed elements 54' can be precisely located along the surface of the body forming portion of the modified sacrificial core and have the advantage that they are more easily provided than making protuberances by molding or machining.

The jet impingement plate 10 is formed in accordance with the process discussed above by depositing body forming material about the modified sacrificial core 56. Again, any of the deposition techniques discussed above are contemplated. However, during the deposition step, body forming material additionally forms about the protuberances 54 and over the ends 55 thereof and makes bumps 64, as shown in FIG. 9, which extend outwardly from external surfaces 66 and/or 68 of the body portion 12 of the jet impingement plate 10.

Once the jet impingement plate 10 is formed about the modified sacrificial core 56, the sacrificial core 56 is to be removed and the jet impingement orifices 18 must be finished. The jet impingement orifices 18 can be completed either while the modified sacrificial core 56 is still within the jet impingement plate 10 or after the sacrificial core 56 has been removed. Preferably, the bumps 64 are ground or otherwise machined from the external surfaces 66 and 68 of the jet impingement plate while the modified sacrificial core 56 is within the jet impingement plate 10. Any other conventional techniques are contemplated for removing the forming material comprising the bumps 64. In fact, since it is preferable to also finish the external surfaces 66 and 68 of the jet impingement plate 10 to ensure an even surface, the bumps 64 can be removed during the same finishing step. Once the bumps 64 are removed, the jet impingement orifices 18 are fully formed. If the modified sacrificial core 56 is left within the jet impingement plate 10 during the finishing step, it can thereafter be removed in any of the removing manners discussed above. Advantageously, the jet impingement orifices 18 provide additional access openings through which the sacrificial core material can be removed. If the sacrificial core 56 is removed prior to finishing the jet impingement orifices 18, then the jet impingement plate 10 is complete once the jet impingement orifices 18 are done.

If the protuberances 54 are provided by separately formed elements 54', discussed above, it may be preferable or necessary to remove the elements 54 by an additional step. If the elements 54' have a lower melting temperature than the body forming material making up the jet impingement plate 10, then they can be removed by melting with the sacrificial core. The elements 54' can also be removed by decomposition or dissolving independant of how the rest of the sacrificial core is removed.

For example, the protuberances can comprise elements 54' made up of copper wire inserted within a wax or plastic sacrificial core 56. Then, nickel can be deposited by electroplating. After an access opening is provided, the sacrificial core 56 can be removed by melting, while leaving the copper elements 54' within the jet impingement orifices 18. Therafter, the copper elements 54' can be separately removed by applying a conventional etchant within a conventional stripping process that removes copper from nickel Specifically, a solution of 12 oz./gal. (90 grams/liter) of sodium cyanide and 2 oz./gal. (15 grams/liter) of sodium hydroxide is well known to strip copper from nickel when applied in a conventional stripping process.

As shown in FIG. 10, the body portion 12 of the jet impingement plate 10 is provided with jet impingement orifices 18 directing heat transfer fluid from opposed major surfaces of the body portion 12 of the jet impingement plate 10. The jet impingement orifices 18 are advantageously provided with curved profiles which facilitate fluid flow through the jet impingement orifices 18. Such profiles are defined by the external profiles of the protuberances 54 from the modified sacrificial core 56. Many other profiles are contemplated which are limited by the ability to form the modified sacrificial core 56. Another important advantage of making the jet impingement orifices 18 in the manner of FIGS. 8-10 is that such method eliminates the drilling or machining of individual holes, thereby reducing the amount of labor involved in the jet impingement plate 10 production.

Yet another method of making the jet impingement orifices 18 comprises using photoresist technology. To do this, the sacrificial core 30, at least at a portion of the body forming portion 32 thereof, is coated with a photoresist material. Photoresist coatings change when the coatings are exposed to light. Photoresist coatings particularly suitable for the present invention are those which exhibit a change in solubility and result in solvent discrimination between areas exposed and unexposed to light. Photoinitiated cross-linking and/or polymerization decrease solubility, where as photomodification of functionality and photodegradation increase solubility. Thus, exposure of the coating to a pattern of light results in solubility changes, and resist images are formed by the boundaries of solubility changes.

In the present case, the photoresist coating is exposed to a predetermined pattern of light defining the pattern desired for the jet impingement orifices 18. If the photoresist coating is decreased in solubility by exposure to light, then the pattern of light should correspond to the jet impingement orifices 18 themselves. If the photoresist coating is increased in solubility by light, then the patter of light should correspond to the areas between the jet impingement orifices 18. In either case, the more soluble coating portions can be washed away leaving the pattern of the jet impingement orifices 18 on the body forming portion 32.

The photoresist coating in the pattern of the jet impingement orifices 18, if non-conductive, can be applied to a conductive or rendered conductive sacrificial core so that during electroplating, body forming material does not deposit on the photoresist coating. In another way, the photoresist coating in the pattern of the jet impingement orifices 18 can be built up sufficiently so as to provide protuberances similar to those shown in FIGS. 8-10, and the jet impingement orifices 18 could be finished in the same way. As above, any of the deposition methods could be used with this technique.

Thereafter, the sacrificial core 30 including the photoresist material can be removed in accordance with any of the methods discussed above. It may also be necessary to further treat the jet impingement plate 10 to remove or dissolve the photoresist material in a way that will not harm the body forming material. For example, organic photoresist material could be dissolved in a caustic solution, such as a sodium hydroxide and water solution, without harming the body forming material, such as nickel.

Although the deposition step of forming material to form the unitary jet impingement plate 10 can be any known deposition technique in accordance with the above, a specific example of a suitable preferred electroplating technique is described as follows. In one example, a sacrificial core was produced out of a 58% bismuth, 42% tin alloy, available as "INDALLOY 281" having a melting point of 281° F. by forming the sacrificial core within a mold. The mold defined a pattern of holes within the sacrificial core. Since the sacrificial core was made of a conductive material, no additional step was required to render it conductive. Next, the sacrificial core was mounted on a brass turning rod for electroplating.

Thereafter, the sacrificial core and brass turning rod were immersed in a nickel sulfamate bath (not shown) containing 16 ounces/gallon of nickel; 0.5 ounces/gallon of nickel bromide; and 4.0 ounces/gallon of boric acid. Also, 0.1 ounces/gallon of a surfactant, namely "DUPONAL ME" available from E. I. DuPont de Nemours and Company of Wilmington, Del., was added to the bath to prevent $H_2$ bubbles from sticking to the surfaces of the sacrificial core and to thereby reduce gas pitting. The remainder of the plating bath was filled with distilled water. A quantity of S-nickel anode pellets were contained within a titanium basket which was suspended in the plating bath. A woven polypropylene bag was provided surrounding the titanium basket for trapping particulates within the plating bath. The plating bath was continuously filtered through a 5 micron filter. The temperature of the bath was maintained at 90° F., and a pH of 4.0 was maintained in the plating bath solution. A current density of 10 amps per square foot was applied to the sacrificial core for 48 hours. The voltage applied to the sacrificial core is a function of the temperature of the bath to produce the desired amps. Upon removal the sacrificial core included a shell surrounding it made up of nickel having an average uniform thickness of 24 mils (0.610 mm). As a general rule, at 20 amps per square foot, the nickel is deposited at a rate of approximately 1 mil/hr 0.0254 mm/hr). Moreover, at 10 amps per square foot, the nickel is deposited at an approximate rate of 0.5 mil/hr (0.0127 mm/hr). Slower formation generally increases strength and improves uniformity of wall thicknesses and posts.

After deposition, an access opening was provided by cutting away a portion of the nickel shell, and the nickel shell containing the sacrificial core was heated to a temperature above the melting temperature (281° F.) of the bismuth-tin alloy comprising the sacrificial core, but below the melting temperature of nickel. Such access opening was arranged downwardly so that as the sacrificial core material was melted, the material flowed out of the nickel shell. As a result, clean passages were provided. Moreover, a plurality of apertured posts were formed at each of the locations of the holes according to the hole diameter and spacing and pattern of holes provided within of the sacrificial core.

Then, the jet impingement orifices were made in the body portion at a desired pattern, spacing and diameter by EDM Machining.

Unitary jet impingement plates formed in accordance with the present invention are improved structurally with the passage 24 of the body portion 12 in fluidic communication with one or both of the passages 22 and 28 of the first and second manifolds 14 and 16, respectively, without leakage problems. Moreover, the structural integrity is further improved by the pattern of posts 48 which strengthen the body portion 12. This strength is particularly important in that the body portion 12 can handle heat exchange fluids at relatively high pressures with a minimum of plate deflection thereby providing high heat transfer rates. Minimizing plate deflection is critical when using the heat exchanger adjacent to certain components such as electronic circuitry since deflection could adversely affect the heat transfer fluid jets 26 and thus the heat transfer rate and the components themselves.

It is also noted, that throughout the illustrations of the Figures, the height of the body portion 12 with respect to the diameter, in cross-section, of the first and second manifolds 14 and 16 is greatly exaggerated for clarity. That is not to say that the jet impingement plate 10 cannot be formed with such a dimensional ratio, but that it is preferable to keep the thickness of the body portion 12 relatively thin as compared to the size the passages within the manifolds so that a relatively large amount of heat exchange fluid can be readily available to flow into the body portion 12 and to easily position the body portion 12 adjacent to a component or circuitry to be cooled. Further in this regard, the body portion 12 can advantageously be positioned off center of the plane connecting the axis lines of the first and second manifolds 14 and 16 so that the body portion 12 can be more easily positioned closer to a component.

Figure 11:
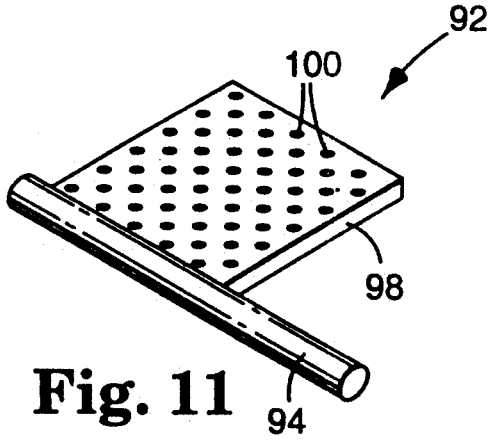
FIG. 11 is a perspective view of yet another sacrificial core having a pattern of holes provided through the body forming portion thereof for forming a jet impingement plate having structural posts provided in the pattern of the holes of the sacrificial core.
Figure 12:
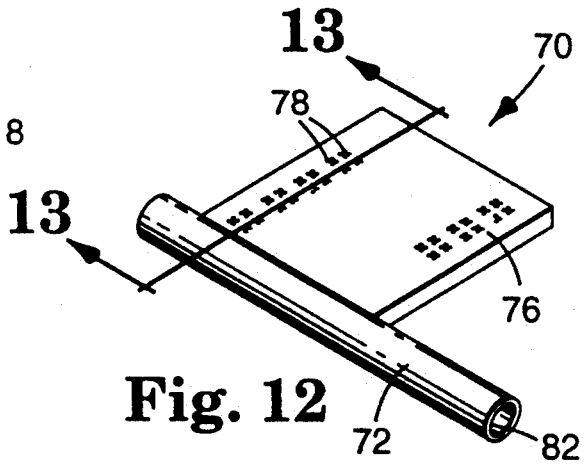
FIG. 12 is a perspective view of a jet impingement plate formed about the sacrificial core of FIG. 11 and further including jet impingement orifices in the body portion thereof.
Figure 13:
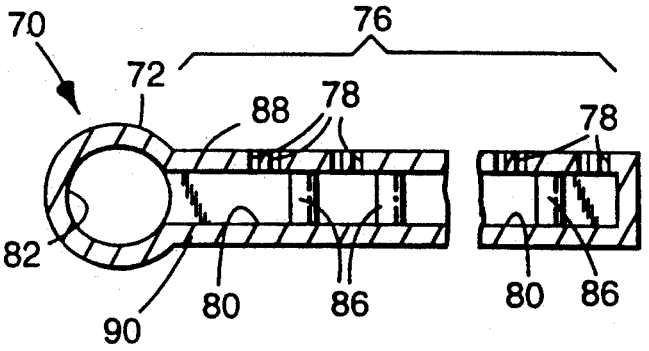
FIG. 13 is a partial cross-sectional view taken along line 13—13 in FIG. 12 after the sacrificial core has been removed.

Referring now to FIGS. 11-13, yet another embodiment of a jet impingement plate 70 formed in accordance with the present invention is illustrated. Specifically with reference to FIGS. 12 and 13, the jet impingement plate 70 includes a manifold 72 provided along an edge of a body portion 76. The manifold 72 is connectable to a fluid source as part of a fluid circuit through which heat transfer fluid can be circulated. The jet impingement plate 70 is illustrated with only one manifold 72, but it is understood that two or more of such manifolds can be provided. Moreover, other manifolds can be further connected with heat transfer fluid sources or drain lines and reservoirs depending on the specific application and heat transfer requirements. The jet impingement plate 70 can be used as a heat source or as a heat sink for heating or cooling a component or other medium positioned adjacent to or flowing next to the jet impingement plate 70.

The body portion 76 is integrally made with and of the same material as the manifold 72 in accordance with the forming method described above. The body portion 76 is further provided with a pattern of jet impingement orifices 78. The jet impingement orifices 78 provide openings connected from the internal passage 80 of the body portion 76 which is in turn connected with the internal passage 82 of the manifold 72. Thus, heat transfer fluid supplied within the manifold 72 flows within the internal passage 82 thereof and then through the internal passage 80 of the body portion 76 and is directed from the jet impingement plate 70 through jet impingement orifices 78.

The jet impingement orifices 78 are illustrated in a preferred pattern for providing substantially equal heat transfer fluid impingement over a surface of a component to thermally affected. As above, other patterns for the jet impingement orifices 78 depending on the specific application and the desired result are also contemplated. The specific pattern illustrated in FIG. 12 is also spaced to accommodate posts 86 which are integrally connected between a first plate 88 and a second plate 90 of the body portion 76. The posts 86 are preferably provided similarly as the apertured post 48 in the above described embodiments for enhancing the structural integrity of the jet impingement plate 70. As discussed below, the posts 86 and the apertured posts 48 are instrumental in helping to reduce plate deflection under relatively high fluid pressures when using the jet impingement plate 70 for heating or cooling a component by directing heat transfer fluid against such a component. Moreover, the specific pattern that the posts 86 and/or posts 48 are provided affects such structural integrity.

In order to produce the jet impingement plate 70 including the posts 86, a sacrificial core 92 is provided including a manifold forming portion 94, connected with a body forming portion 98 by adhering, melt-fusing or the like. The sacrificial core 92 has an overall shape generally similar to the overall shape of the jet impingement plate 70 which is formed by depositing body forming material about the sacrificial core 92. If an additional manifold or manifolds are desired, additional manifold forming portions could be connected with the body forming portion 98 in a similar manner as manifold forming portion 94.

In order to make the posts 86, the sacrificial core 98 is provided with holes 100 provided through the body forming portion 98 and in a pattern corresponding to the desired pattern of the posts 86 within the body portion 76 of the jet impingement plate 70. Thus, during deposition of body forming material about sacrificial core 92, body forming material deposits on internal surfaces of each of the holes 100 to integrally provide the posts 86 formed with the first and second plates 88 and 90 of the body portion 76. Depending on the rate of body forming material deposition and the control of such deposition, the posts 86 may be solid, hollow or provided with an aperture passing therethrough similar to the apertured posts 48 of the earlier embodiments. Moreover, all of the deposition techniques discussed above are contemplated for making the jet impingement plate 70 with posts 86. Note that the posts 86 can be formed closed at the tops and bottoms thereof but hollow in the center because of the tendency during electroplating for material to deposit faster at the sharp edges of the sacrificial core 92. Slower deposition rates and/or bevelled edges of the holes 100 reduce this tendency to provide stronger solid posts 86.

After the jet impingement plate 70 is formed about the sacrificial core 92, the sacrificial core 92 is removed. As above, at least one access opening must be provided through which the sacrificial core material can be removed. Again, such removal may occur by melting, decomposing or dissolving by solution the sacrificial core 92. The access openings can be provided in any of the manners discussed above.

The jet impingement orifices 78 can be provided during the forming of the jet impingement plate 70 or may be provided before or after the sacrificial core 92 is removed. Again, the jet impingement orifices 78 can be formed by a drilling or machining process before or after the sacrificial core 92 is removed. Alternatively, the jet impingement orifices 78 can be made during the deposition step by forming the body forming portion 98 of the sacrificial core 92 with protuberances (not shown) in the pattern of the jet impingement orifices 78 or by using photoresist technology, as described above. In the case of providing protuberances, a finishing step would be required.

In accordance with preferred embodiments of the present invention, it is an important aspect to minimize plate deflection of the jet impingement plate 10 or 70 when it is connected with pressurized fluid sources and when the jet impingement plate 10 or 70 is to be precisely positioned relative to a component, such as electronic circuitry, which is to be thermally affected. Excessive deflection of the body portion 12 or 76 could adversely affect the heat transfer capability of such a jet impingement plate 10 or 70 as well as the electronic components themselves. In order to minimize any adverse effects, it is preferable to maintain plate deflection at any specific point below 0.003 inches. Such is especially true for use in densely packed electronic circuit environments of the type where there is little room for tolerances and where relatively high heat transfer rates are required. In less sensitive environments, greater plate deflection can be tolerated.

A jet impingement plate constructed in accordance with the embodiment shown in FIGS. 11-13 was tested at 50 points over the body portion thereof while connecting the manifold thereof to a fluid pressure source of 25 p.s.i. and then to a fluid pressure source of 50 p.s.i. Table 1 below shows the average measured deflection at 25 p.s.i. and 50 p.s.i. as compared to 0 pressure. No jet impingement orifices were provided in the subject body portion of the jet impingement plate so that the jet impingement plate could be statically pressurized.

TABLE 1

| Location | Deflection (× 0.001") @ 25 p.s.i | @ 50 p.s.i |
|---|---|---|
| 1 | 0.5 | 1.2 |
| 2 | 1.2 | 2.1 |
| 3 | 1.7 | 2.9 |
| 4 | 2.3 | 4.4 |
| 5 | 2.4 | 4.8 |
| 6 | 1.2 | 2.3 |
| 7 | 1.5 | 2.6 |
| 8 | 2.1 | 4.2 |
| 9 | 2.7 | 5.5 |
| 10 | 0.9 | 1.6 |
| 11 | 1.6 | 2.4 |
| 12 | 2.1 | 3.6 |
| 13 | 2.4 | 4.5 |
| 14 | 2.7 | 5.0 |
| 15 | 1.9 | 2.9 |
| 16 | 2.0 | 3.5 |
| 17 | 3.0 | 5.0 |
| 18 | 3.4 | 6.1 |
| 19 | 0.8 | 1.4 |
| 20 | 1.7 | 3.0 |
| 21 | 2.3 | 3.9 |
| 22 | 2.4 | 5.0 |
| 23 | 2.1 | 3.5 |
| 24 | 1.0 | 2.1 |
| 25 | 1.1 | 2.5 |
| 26 | 1.7 | 3.6 |
| 27 | 1.2 | 3.5 |
| 24 | 1.0 | 2.3 |
| 25 | 1.4 | 2.6 |
| 26 | 1.8 | 3.7 |
| 27 | 1.6 | 3.5 |
| 28 | 1.1 | 2.0 |
| 29 | 1.6 | 3.4 |
| 30 | 2.2 | 4.4 |
| 31 | 2.3 | 4.7 |
| 32 | 1.4 | 2.7 |
| 33 | 1.5 | 3.1 |
| 34 | 2.0 | 3.9 |
| 35 | 2.4 | 4.4 |
| 36 | 2.4 | 4.9 |
| 37 | 1.2 | 2.4 |
| 38 | 1.5 | 3.3 |
| 39 | 1.9 | 4.1 |
| 40 | 1.8 | 3.5 |
| 41 | 1.2 | 2.2 |
| 42 | 1.6 | 3.3 |
| 43 | 1.8 | 3.4 |
| 44 | 1.8 | 3.6 |
| 45 | 1.6 | 3.3 |
| 46 | 1.3 | 2.8 |
| 47 | 1.8 | 3.9 |
| 48 | 1.8 | 3.9 |
| 49 | 1.4 | 2.9 |

TABLE 1-continued

| Location | Deflection (× 0.001") @ 25 p.s.i | @ 50 p.s.i |
|---|---|---|
| 50 | 1.0 | 2.2 |

In order to perform the deflection tests, a linear displacement transducer with a resolution to 0.0001 inch was mounted in a fixed position over a granite surface plate, and the jet impingement plate was mounted in a fixture which held the plate by its edges and allowed the plate to be moved under the transducer to each test position. The 50 test points were chosen in the areas of maximum deflection which is midway between the structural posts. By holding the jet impingement plate by its edges, the measured deflection is the deflection from the plate center to one side thereof. At zero pressure the height of each test point above an arbitrary reference on the linear displacement transducer was measured 3 times and averaged. This zero height reference was then subtracted from the height measurements made for each test point at 25 p.s.i. and 50 p.s.i. to give the deflection measurements. The 25 p.s.i. and 50 p.s.i. measurements were based on an average of 2 displacement readings. Moreover, the entire set of 50 points were moved under the displacement transducer for one set of readings before a second or third set of readings were taken. The 25 p.s.i. data was taken after the initial zero p.s.i. data. Then, the 50 p.s.i. data was taken and finally a set of post pressurization zero p.s.i. data was taken.

The tests were conducted on a body portion of a jet impingement plate that had been machined to finish the external surface thereof which determined the final plate thicknesses. The machining operation provided visible surface variations which resulted in thinner areas of the plate thickness of the jet impingement plate body. As seen in Table 1, the effect on deflection of such thin spots were shown at points 17, 18, 35 and 36. Then, in order to verify that these areas of greatest deflection were caused by plate thinning, cross-sections were taken through the plate through lines connecting points 15-18 and 33-36. The plate thickness at the included points were measured to be as follows: point 15=0.023 inch; point 16=0.021 inch; point 17=0.018 inch; point 18=0.018 inch; point 33=0.020 inch; point 34=0.019 inch; point 35=0.018 inch; and point 36=0.018 inch. The thinnest points 16, 17, 35 and 36 were the same points having maximum deflections. Points 15, 16 and 33 had thicknesses of at least 0.020 inches and the deflection results were well within acceptable limits Lastly, the measurements taken at zero pressure after the other pressurization tests showed no significant permanent or plastic deformation of the jet impingement plate body.

Figure 14:
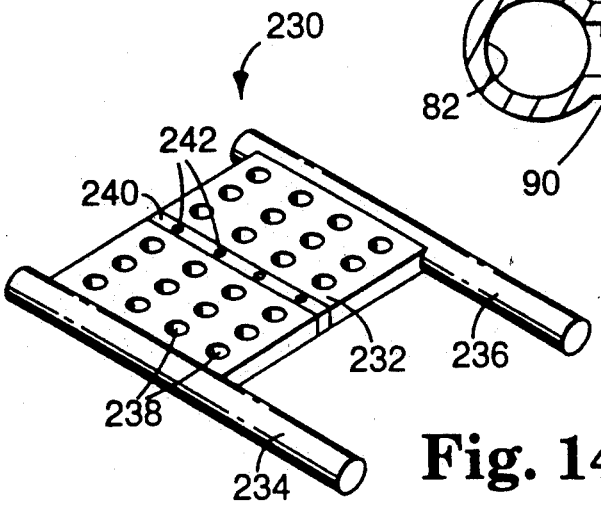
FIG. 14 is a perspective view of another sacrificial core for making a compartmentalized jet impingement plate in accordance with the present invention.

Yet another embodiment of a sacrificial core 230 in accordance with the present invention is illustrated in FIG. 14. The sacrificial core 230 is advantageous in that the jet impingement plate formed therefrom is divided into compartments. To accomplish this, the body forming portion 232 of the sacrificial core 230 is provided with a first manifold forming portion 234 and a second manifold forming portion 236. Preferably, holes 238 are also provided for forming posts within the jet impingement plate formed thereabout. In order to divide the body of the jet impingement plate into separate compartments, the body forming portion 232 is provided with a divider strip 240 of a material compatible with or the same as the body forming material to be deposited. For example, if electroplating is to be utilized, the divider strip 240 preferably comprises a conductive metal, and more preferably of the same material to be deposited by electroplating, i.e. a nickel divider strip 240 when nickel is to be plated.

The deposited body forming material becomes integral with the divider strip 240 along the exposed edges thereof during deposition so that after the sacrificial core 230 is removed two separate compartments are provided, each compartment with its own manifold Holes 242 are also preferable provided within divider strips 240 to anchor the divider strip within the jet impingement plate by deposition.

Thus, each separate compartment can be independantly controlled and supplied with heat transfer fluid. Moreover, one of the manifolds could be connected with a drain or suction line for removing or recirculation heat transfer fluid. In the regard, the jet impingement orifices could be advantageously provided in one compartment for impinging heat transfer fluid while being provided in the other compartment for removing the heat transfer fluid. Furthermore, the jet impingement orifices can be provided through opposite plates of the jet impingement plate.

It is further understood that many modifications can be made to the jet impingement plates discussed above in accordance with the present invention. In this regard, many other shapes or geometries are contemplated for the body portion of such jet impingement plate. Specifically, a jet impingement plate could be provided with one or more curved surfaces, or may be made in the form of a geometric object such as a cone or the like. The shape of such jet impingement plate being limited by the ability to mold or otherwise make the sacrificial core and the ability to deposit body forming material on its surfaces. The ability to make jet impingement plates of complex shapes allows such jet impingement plates to be designed to fit very nearly against components of complex surfaces or geometries or to be used in environments otherwise requiring such complex shapes.

For example, with reference to FIG. 7, the body portion 12 could be formed to include stepped portions to correspond to the changes in levels of the electronic circuit components of the illustrated circuit board. The jet impingement orifices 18 could all be substantially equidistant from the component to which it is directed.

It is also contemplated that the manifolds for the jet impingement plate can be integrally made and connected with the body portions in many different ways. Again, such is accomplished by appropriately forming the sacrificial core. Specifically, the manifold forming portion thereof could be provided to extend longitudinally, circumferentially, along an edge or any intermediate portion of any body portion of such a jet impingement plate. Such is true of generally planar body portions as well as those involving more complex geometries.

Additionally, the materials used to form the unitary heat exchanger can comprise any material which can be deposited about the sacrificial core, which is strong enough to handle the pressures associated with the heat exchanger, and which is capable of maintaining its structural integrity during the step of removing the sacrificial core by melting, dissolving, decomposition, or the like. Preferable materials include nickel and copper which are easily electrochemically applied by either electroless plating or electroplating as described above.

It is also contemplated to apply forming materials in layers which can be chosen depending on the circumstances and environment of the application for a specific heat exchanger. For example, it might be desirable to first deposit a layer of nickel onto the sacrificial core because of its strength and corrosion resistant properties with certain fluids, and then to deposit copper as the remainder of the body to take advantage of its better heat conductivity. Such controlled deposition can easily be accomplished by electroplating.

Thus, the scope of the present invention should not be limited to the structures described by the plural embodiments of this application, but only by the limitations of the appended claims.

We claim:

1. A method of making a unitary jet impingement plate to be connected with a heat transfer fluid source, the jet impingement plate including a body portion with an internal passage therein and having a jet impingement orifice passing through a plate of the body portion for providing a fluid connection between the internal passage and external of the body portion and for directing a heat transfer fluid jet therefrom, said method comprising the steps of:

(a) forming a sacrificial core with a body forming portion;

(b) placing the sacrificial core within a controlled environment comprising at least one of an ambient solution and gas from which forming material can be deposited onto the sacrificial core and depositing forming material about the sacrificial core from the controlled environment for at least partially surrounding and forming a shell about the sacrificial core, said deposition step thereby integrally creating the body portion of the unitary jet impingement plate;

(c) providing an access opening through the shell of the unitary jet impingement plate so as to provide access to the sacrificial core from outside the shell;

(d) removing the sacrificial core from within the unitary jet impingement plate through the access opening, thereby leaving the internal passage within the body portion of the unitary jet impingement plate; and (e) providing a jet impingement orifice through a plate of the body portion that was formed during said deposition step for directing heat transfer fluid from the jet impingement plate.

2. The method of claim 1, wherein said step of providing a jet impingement orifice further comprises providing a plurality of jet impingement orifices arranged in a pattern.

3. The method of claim 2, wherein said step of providing the jet impingement orifices is conducted while the sacrificial core is within the body portion of the jet impingement plate.

4. The method of claim 3, further including providing at least one jet impingement orifice through plates at a plurality of sides of the jet impingement plate so that heat transfer fluid jets can be directed in plural directions from the jet impingement plate.

5. The method of claim 2, wherein said step of providing the jet impingement orifices comprises providing protuberances extending from at least one surface of the body forming portion of the sacrificial core which are also deposited with forming material during said deposition step, and removing the body forming material that was deposited on ends of the protuberances after said deposition step is complete.

6. The method of claim 5, wherein said step of removing the body forming material that was deposited on the ends of the protuberances is conducted while the sacrificial core is within the body portion of the jet impingement plate.

7. The method of claim 5, wherein said step of providing protuberances comprises forming the protuberances of the same material as the sacrificial core.

8. The method of claim 5, wherein said step of providing protuberances comprises inserting a plurality of separately made elements of a different material than the sacrificial core into the body forming portion thereof while leaving a distal end of such elements extending from the at least one surface of the body forming portion.

9. The method of claim 8, further wherein the elements inserted within the body forming portion of the sacrificial core comprise metal wires, and the method further comprises the step of removing the metal wires from within the jet impingement orifices as a separate step from the step of removing the sacrificial core by applying an etchant to the metal wires after said deposition step.

10. The method of claim 9, wherein the body forming material deposited is nickel, the metal wires are copper, and the etchant comprises a solution of sodium cyanide and sodium hydroxide.

11. The method of claim 2, wherein said step of providing the jet impingement orifices includes the steps of coating at least a portion of the body forming portion with a photoresist coating, exposing the photoresist coating to a pattern of light for changing the solubility of the photoresist coating exposed to light and providing a pattern of less soluble photoresist coating corresponding to the pattern of a plurality of jet impingement orifices bounded by more soluble photoresist coating, and removing the more soluble photoresist coating.

12. The method of claim 11, wherein said forming step includes forming the body portion of the sacrificial core with a conductive outer surface, the photoresist coating applied during said coating step is non-conductive, and said deposition step comprises electroplating so that the jet impingement orifices are formed during said deposition step.

13. The method of claim 11, further including the steps of building up the photoresist coating in the pattern of a plurality of jet impingement orifices to provide protuberances extending from at least one surface of the body forming portion of the sacrificial core which are also deposited with body forming material during said depositing step, and removing the body forming material that was deposited on ends of the protuberances after said deposition step is complete.

14. A method of making a unitary jet impingement plate to be connected with a heat transfer fluid source, the jet impingement plate including a body portion with an internal passage therein and having a jet impingement orifice passing through a plate of the body portion for providing a fluid connection between the internal passage and external of the body portion and for directing a heat transfer fluid jet therefrom, said method comprising the steps of:

(a) forming a sacrificial core with a body forming portion and providing an internal surface on the body forming portion for defining at least one hole through the body forming portion of the sacrificial core;

(b) depositing forming material about the sacrificial core including the internal surface of the body forming portion for at least partially surrounding and forming a shell about the sacrificial core, said deposition step thereby integrally creating the body portion of the unitary jet impingement plate and a post of forming material connecting opposite sides of the shell;

(c) providing an access opening through the shell of the unitary jet impingement plate so as to provide access to the sacrificial core from outside the shell;

(d) removing the sacrificial core from within the unitary jet impingement plate through the access opening, thereby leaving the internal passage within the body portion of the unitary jet impingement plate; and (e) providing a jet impingement orifice through a plate of the body portion that was formed during said deposition step for directing heat transfer fluid from the jet impingement plate.

15. The method of claim 14, wherein said deposition step further includes controlling the thickness of deposition of forming material with respect to the dimensions of the internal surface of the hole so that an aperture passing through the post remains after said deposition step is complete.

16. The method of claim 14, including providing a plurality of internal surfaces on the body forming portion for defining a like plurality of holes through the body forming portion of the sacrificial core, wherein, during said deposition step, the forming material is deposited onto each of the internal surfaces of the body forming portion thereby creating a like plurality of posts of forming material connecting opposite sides of the shell.

17. The method of claim 16, wherein said deposition step further includes controlling the thickness of deposition of forming material with respect to the dimensions of at least one of the internal surfaces of the holes so that at least one aperture passing through a post remains after said deposition step is complete.

18. The method of claim 17, wherein said step of providing the plurality of internal surfaces on the body forming portion defining the plurality of holes comprises providing internal surfaces defining holes through the body forming portion of the sacrificial core of at least two different size dimensions, thus providing a first set of holes that form a first set of posts during said deposition step and a second larger set of holes that form a second set of apertured posts during said deposition step.

19. The method of claim 1, wherein said step of depositing the forming material comprises electrochemical deposition, said sacrificial core is formed of one of a wax, plastic and fusible alloy having a softening temperature lower than that of the forming material, and said step of removing the sacrificial core comprises melting the sacrificial core and allowing the molten sacrificial core to flow out of the access opening.

20. The method of claim 1, wherein said step of forming the sacrificial core further comprises forming the body forming portion substantially planar.

21. The method of claim 1, wherein said step of forming the sacrificial core further comprises providing a dividing element within the body forming portion for connecting with the body portion of the jet impingement plate during said deposition step and for dividing the internal passage of the body portion of the jet impingement plate into a plurality of separate compartments.

22. The method of claim 21, further including the step of providing a separate manifold for each of the plurality of compartments.

23. A method of making a unitary jet impingement plate to be connected with a heat transfer fluid source, the jet impingement plate including a manifold and a body portion with an internal passage therein and having a jet impingement orifice passing through a plate of the body portion for providing a fluid connection between the internal passage and external of the body portion and for directing a heat transfer fluid jet therefrom, said method comprising the steps of:

(a) forming a sacrificial core with a body forming portion and a manifold forming portion connected with an edge of the body forming portion;

(b) depositing forming material about the sacrificial core for at least partially surrounding and forming a shell about the sacrificial core, said deposition step thereby integrally creating the body portion and manifold of the unitary jet impingement plate;

(c) providing an access opening through the shell of the unitary jet impingement plate so as to provide access to the sacrificial core from outside the shell;

(d) removing the sacrificial core from within the unitary jet impingement plate through the access opening, thereby leaving the internal passage within the body portion of the unitary jet impingement plate; and (e) providing a jet impingement orifice through a plate of the body portion that was formed during said deposition step for directing heat transfer fluid from the jet impingement plate.

* * * * *

UNITED STATES PATENT AND TRADEMARK OFFICE

CERTIFICATE OF CORRECTION

PATENT NO. : 5,249,358

DATED : October 5, 1993

INVENTOR(S) : TOUSIGNANT et al.

It is certified that error appears in the above-indentified patent and that said Letters Patent is hereby corrected as shown below:

In the title (on the title page and in column 1, first line), "IMPINGMENT" should read --IMPINGEMENT--.

In column 13, line 4, "orifices 18" should read --the jet impingement plate 10 with jet impingement orifices 18--.

In column 14, line 59, after "nickel" and in column 20, line 52, after "limits" insert a --.--.

Signed and Sealed this

Eleventh Day of October, 1994

*Attest:*

*Attesting Officer*

BRUCE LEHMAN

*Commissioner of Patents and Trademarks*